US006256887B1

(12) United States Patent
Osborne

(10) Patent No.: US 6,256,887 B1
(45) Date of Patent: Jul. 10, 2001

(54) FOLDING KNIFE BLADE RELEASE MECHANISM

(76) Inventor: Warren J. Osborne, 215 Edgefield, Waxahachie, TX (US) 75165

( * ) Notice: Subject to any disclaimer, the term of this patent is extended or adjusted under 35 U.S.C. 154(b) by 0 days.

(21) Appl. No.: 09/309,678

(22) Filed: May 11, 1999

Related U.S. Application Data

(63) Continuation-in-part of application No. 08/775,861, filed on Jan. 2, 1997, now abandoned.

(51) Int. Cl.[7] ..... B26B 1/04
(52) U.S. Cl. ..... 30/161; 30/160; 30/159
(58) Field of Search ..... 30/161, 160, 158, 30/159

(56) References Cited

U.S. PATENT DOCUMENTS

| | | | | |
|---|---|---|---|---|
| 557,760 | * | 4/1896 | Brauer | 30/159 |
| 589,737 | * | 9/1897 | Miller | 30/161 |
| 2,304,601 | * | 12/1942 | Schrade | 30/159 |
| 4,040,181 | * | 8/1977 | Johnson | 30/161 |
| 4,240,201 | * | 12/1980 | Sawby et al. | 30/161 |
| 4,604,803 | * | 8/1986 | Sawby | 30/161 |
| 4,811,486 | * | 3/1989 | Cunningham | 30/158 X |
| 5,325,588 | * | 7/1994 | Rogers | 30/161 |
| 5,722,168 | * | 3/1998 | Huang | 30/160 X |
| 5,839,194 | * | 11/1998 | Bezold | 30/160 X |

FOREIGN PATENT DOCUMENTS

| | | | | |
|---|---|---|---|---|
| 29224 | * | 1/1884 | (DE) | 30/159 |
| 182768 | * | 4/1887 | (FR) | 30/161 |
| 430563 | * | 10/1911 | (FR) | 30/160 |
| 456468 | * | 8/1913 | (FR) | 30/161 |
| 9352 | * | of 1884 | (GB) | 30/160 |
| 13606 | * | of 1906 | (GB) | 30/159 |

* cited by examiner

*Primary Examiner*—Rinaldi I. Rada
*Assistant Examiner*—Boyer Ashley
(74) *Attorney, Agent, or Firm*—John G. Costa

(57) ABSTRACT

A knife has a locking arm with a laterally displacing spring bias that retains the locking arm in a notch on the blade of the knife when the knife is in the open position. A lateral displacement of the locking arm is required to close the knife.

9 Claims, 10 Drawing Sheets

Invention of Osborne
(disclosed in specification)

Invention of Hadden

FOLDING KNIFE BLADE RELEASE MECHANISM

This application is a continuation in part of application Ser. No. 08/775,861 filed Jan. 2 1997, now abandoned.

BACKGROUND OF THE INVENTION

This invention lies in the field of folding knives with mechanisms to secure blades in position. In particular, this invention is directed to a release mechanism for folding blades which are secured in an open position.

Lock back systems have been in use for many years. In a typical lock back folding knife, as a blade is extended or opened, a follower rides along the edge of a cam on the tang of the blade and drops into a notch complementary to the follower. A spring holds the follower in the notch and secures the blade in the open position. In order to close the blade the lock must be released. Conventional release mechanisms provide means for vertically displacing the follower out of the notch. Examples of such knives have been disclosed by Johnson in U.S. Pat. No. 4,040181 and Sawby et. al. in U.S. Pat. No. 4,240,201.

In 1884, in British patent No. 9352 for an automatic pocketknife, Haddan disclosed a mechanism for closing a pocketknife in which a follower was laterally displaced into a groove on the cam of a blade. In Haddan, the follower is part of a locking arm or spring that is under tension. The tension applies a rotational force, or torque, along the edge of the cam to automatically open the blade.

SUMMARY OF THE INVENTION

In the present invention, mechanisms that perrit the closing of a secured folding blade by displacing a torque free follower from a notch are disclosed.

The lock is released and the blade can be closed when a follower is laterally displaced from a notch into a side plate recess, a groove on the cam, or a combination of a side plate recess and a cam groove.

When a follower is displaced out of a notch and into a side plate recess, the blade can be closed. When the blade is in the closed position, the follower may remain in the recess or, in the alternative, the follower can be released from the recess into an insert or indentation, such as, for example, a kick or kickback, on the blade to secure the blade in the closed position.

When a follower is laterally displaced into a groove on a cam, the follower runs in the groove as the blade is folded to the closed position. If the groove runs the entire length of the cam, the follower remains in the groove when the knife is closed. In this instance, when the knife is opened, the follower runs in the groove and slides into the notch from the side to secure the blade in an open and secured position.

Alternatively, the depth of a cam groove tapers to the level of a ridge on the cam. In this instance, when the knife is opened, the follower runs along the ridge of the cam and drops down into a notch to secure the blade in the open position in a manner similar to a conventional lock back system.

A folding knife made in accordance with the disclosed invention comprises a blade, a first side plate, a second side plate, and a locking arm. The blade comprises a first side, a second side, a first edge and a second edge. The first edge and the second edge meet at one end of the blade and are joined together by a tang at the other end of the blade. The tang is preferably curved. The length of the blade extends from one end, such as, for example, a point, of the blade to the other end, such as, for example, a tang, of the blade. The width of the blade extends from the first edge of the blade to the second edge of the blade. The thickness of the blade is measured from the first side of the blade to the second side of the blade. The blade comprises a notch near the junction of the first edge and the tang. The notch extends from the second side of the blade through at least a portion of the thickness of the blade. Preferably, the notch extends across the entire thickness of the blade. Preferably, the blade comprises a kick near the junction of the tang and the second edge of the blade. The kick is a partial thickness inclination of the second surface of the blade toward the first surface of the blade. Optionally, the tang comprises a partial thickness groove along the second side of the blade. The first side plate comprises an inner surface and an outer surface. The inner surface of the first side plate faces the first side of the blade. The second side plate comprises an inner surface and an outer surface. The inner surface of the second side plate faces the second side of the blade. The thickness of each side plate blade is measured from the inner surface of the side plate to the outer surface of the side plate. The locking arm is attached at one end to the inner surface of a side plate. The unattached or free end of the locking arm comprises a follower. The locking arm has a spring like tension that causes the free end of the locking arm to move into the notch when the knife is in the filly open position. For example, when the locking arm is attached to the second side plate and there is no groove in the tang, the tension of the free end of the locking arm causes the free end of the locking arm to displace away from the inner surface of the second side plate and into the notch. As another example, when the locking arm is attached to the first side plate and there is a groove in the tang along the second side of the blade, the tension of the free end of the locking arm causes the free end of the locking arm to displace towards the inner surface of the first side plate and into the notch. When the blade is in the fully open position, the tension of the locking arm displaces the follower into the notch of the blade to secure the blade in the open position. Preferably, the first side plate comprises a thumb indent which extends across the thickness of the first side plate. Optionally, the first side plate comprises means, such as for example, a button, to laterally displace a locking arm. Preferably, the second side plate comprises a recess. A recess is shaped to accommodate at least part of the locking arm. In order to close the knife from its open position, the follower is laterally and completely displaced out of the notch toward the second side plate. When a recess is present in the second side plate, in order to close the knife, at least part of the locking arm, including the follower, is displaced into the recess. When a grove is present in the tang, at least part of the locking arm, including the follower, is displaced into the groove. Furthermore, if both a recess and a groove are present, part of the locking arm will be displaced into the groove and part of the locking arm will be displaced into the recess.

In a knife with a recess in one side plate, the blade notch, the locking arm follower and the side plate recess are aligned so that, when the blade is in the fully open position, the follower is laterally and reversibly displaceable between the notch and the recess. In a knife with an indentation or kickback, the tension of the locking arm causes the follower to displace into the indentation or kickback when the knife is in the fully closed position. In general, when a blade is in a fully closed position an indentation and a recess are aligned such that the follower is laterally and reversibly displaceable between the indentation and the recess.

Furthermore, in a folding knife comprising a blade, a first side plate, a second side plate, and a torque free locking arm, wherein said blade comprises a notch and a tang, said tang comprises a cam, said cam comprises a ridge and a groove, and said locking arm comprises a follower; and wherein, when said blade is in a fully open position, said follower rests in said notch whereby the manual lateral displacement of said follower from said notch into said goove permits said blade to be manually closed; and wherein, when said blade is in a fully closed position, the manual opening of said blade permits said follower to travel along said cam.

DESCRIPTION OF THE PREFERRED EMBODIMENTS

Figure 1:
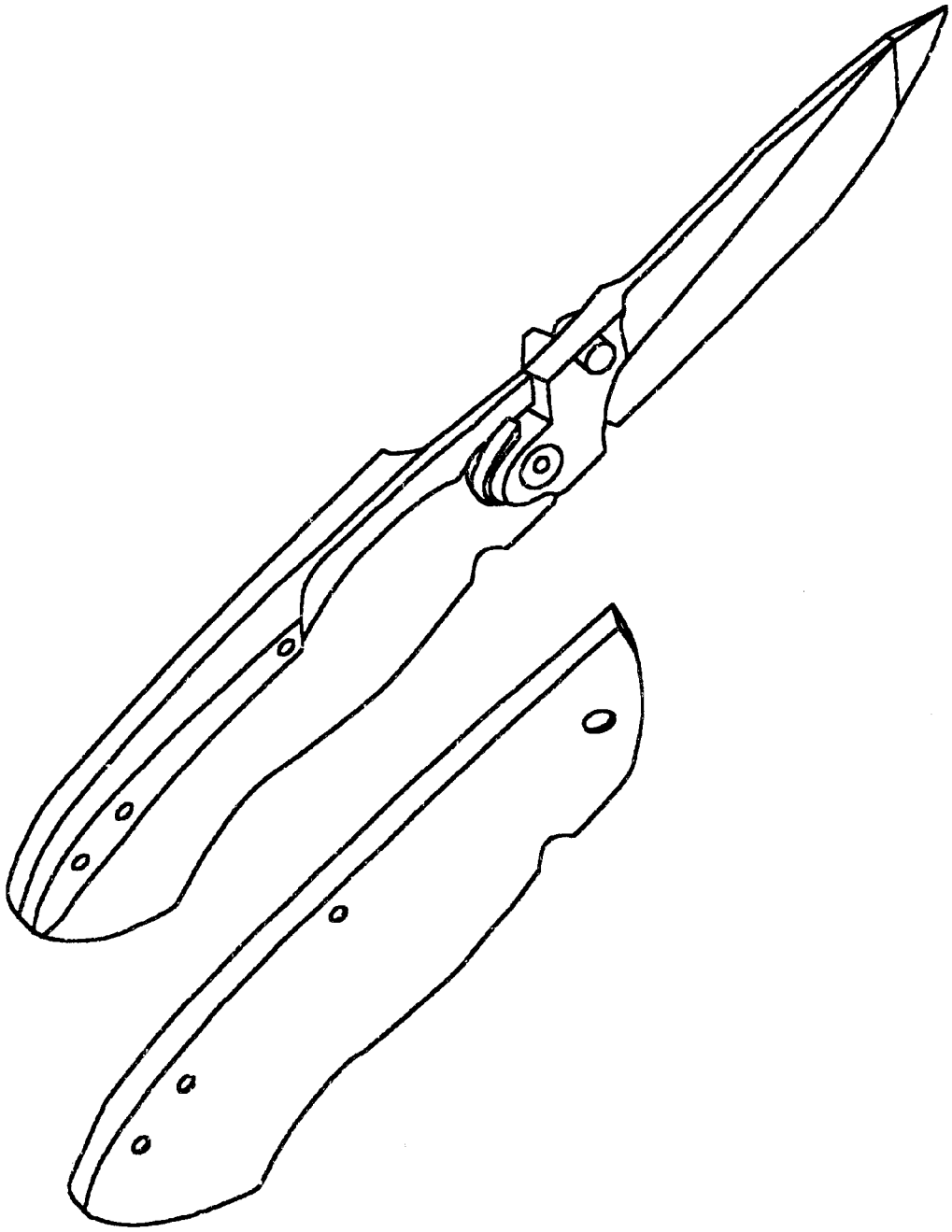
FIG. 1 is a side elevation view of an embodiment of the invention.
Figure 2:
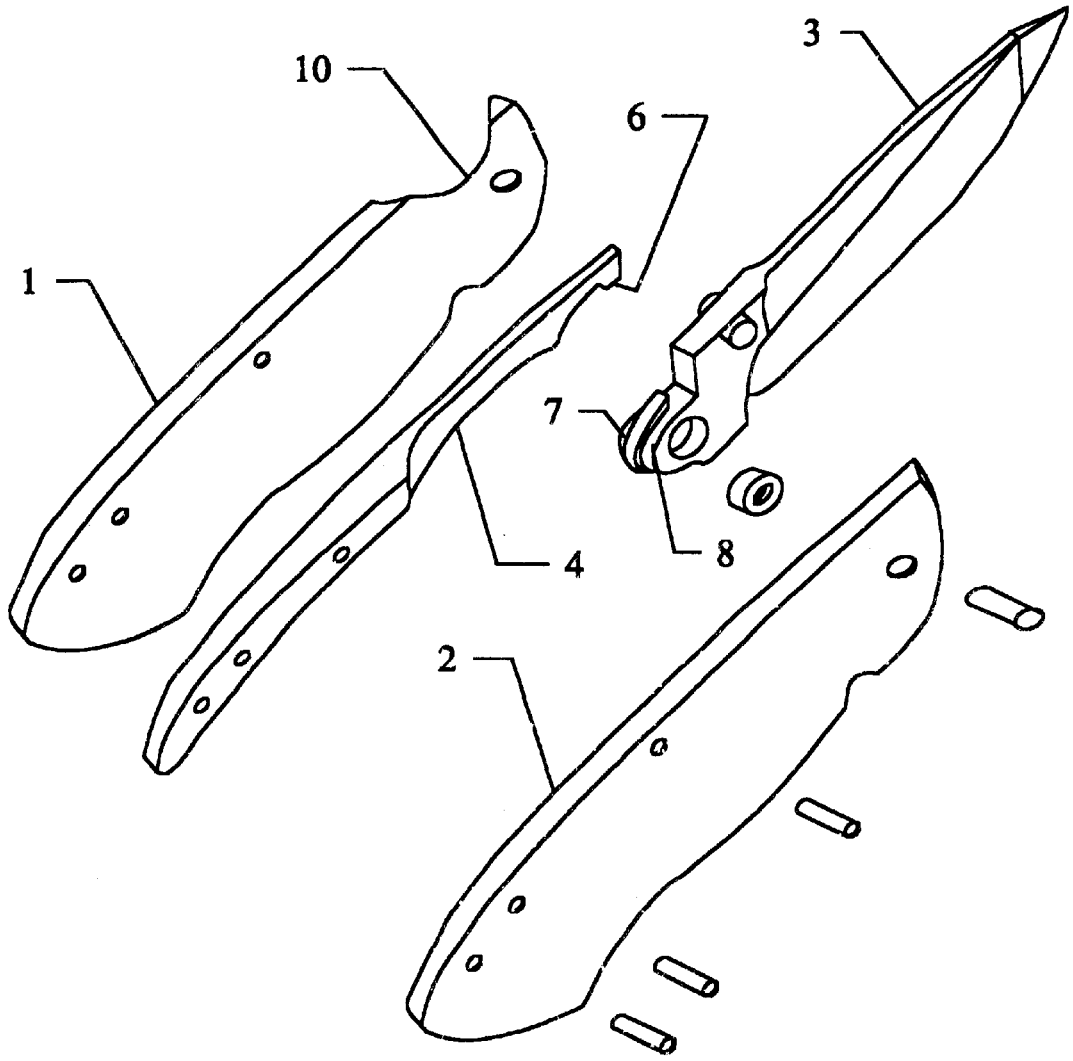
FIG. 2 is an exploded view of the embodiment of FIG. 1.
Figure 3:
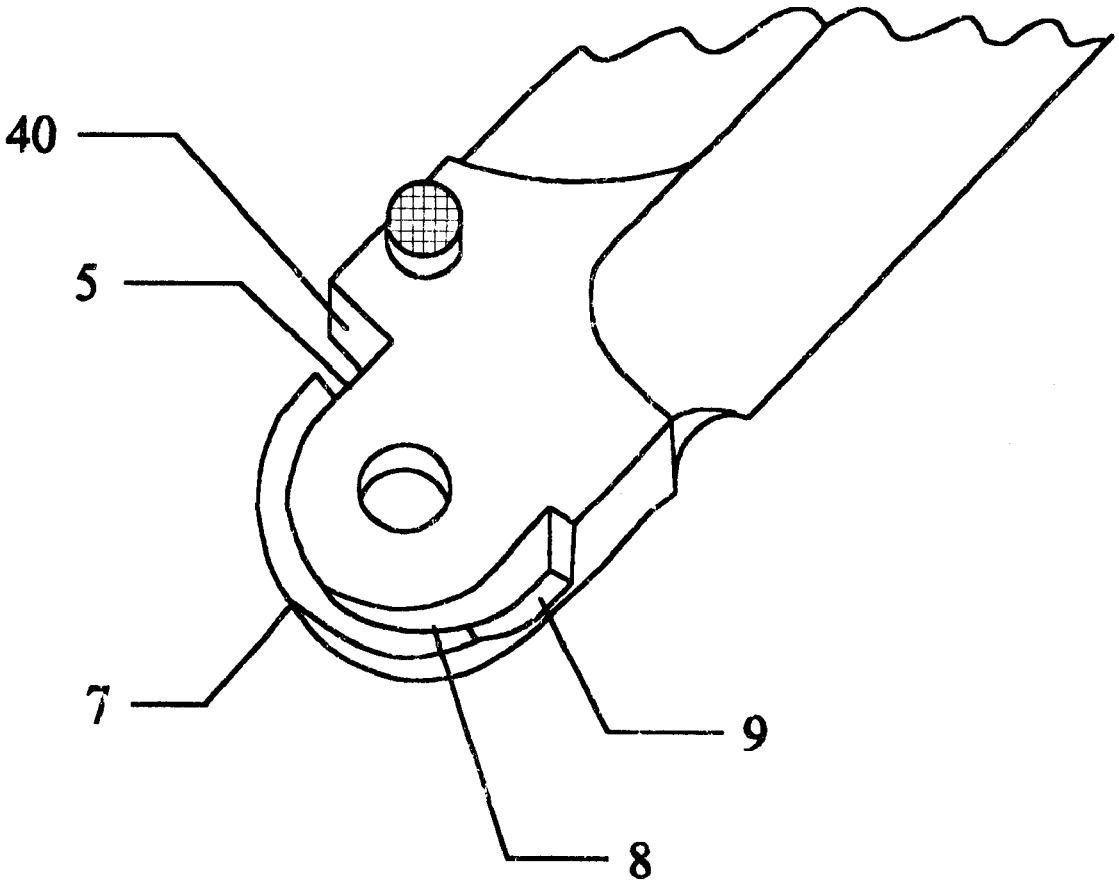
FIG. 3 is a detailed view of the tang of the blade of FIG. 2.
Figure 4:
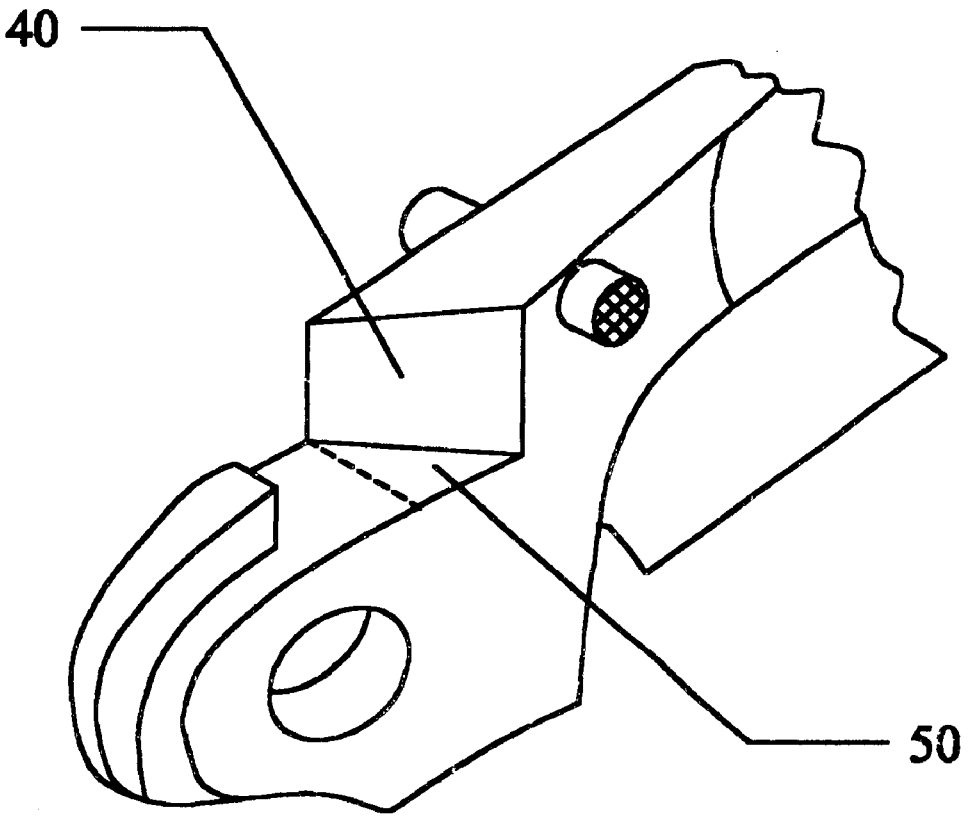
FIG. 4 is a detailed view of the notch of the blade of FIG. 2.
Figure 5:
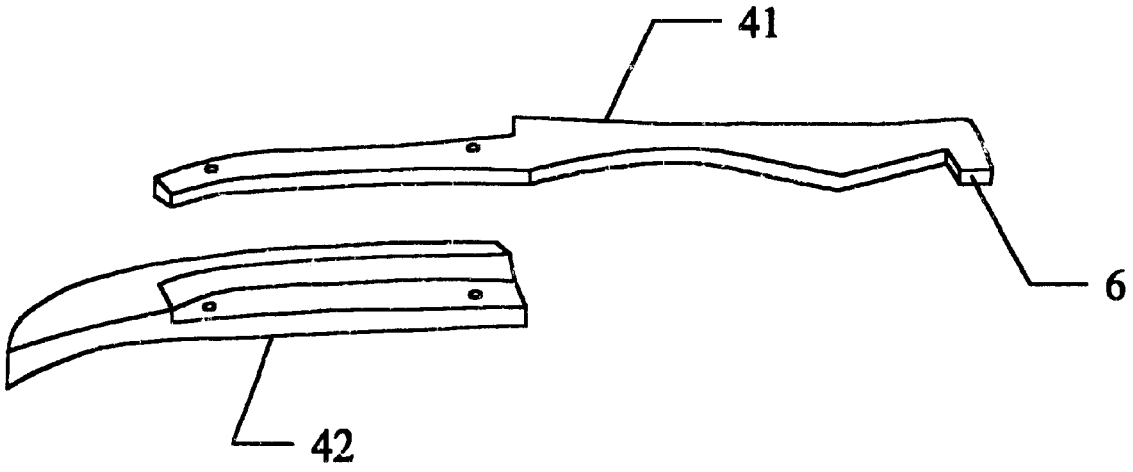
FIG. 5 is an alternative construction for the locking arm of FIG. 2.

FIGS. 1–5 illustrate a folding knife comprising first side plate 1, second side plate 2, blade 3 and locking arm 4. The tang of said blade comprises notch 5 and a cam. Said cam comprises ridge 7 and groove 8. The locking arm comprises follower 6. The follower and notch mate to secure the blade in an open position when the follower rests in the notch. The blade is released from the notch by the lateral displacement of the follower into the groove. Groove 8 comprises kick-back 9. Optional thumb indent 10 is also illustrated. As illustrated in FIG. 4, preferably, the front face 40 of the notch is angled forward. Angle 50, exaggerated for clarity, is preferably about 3° As illustrated in FIG. 5, the locking arm may be constructed in more than one part, 41 and 42. Though not illustrated, part 42 may be integral with side plate 1 so that the side plate 1 and part 42 of the locking arm may be molded or cut from one piece. Part 41 comprises follower 6. The follower of part 41 is identical to the follower of locking arm 4.

In operation, starting from an open and secured position, the follower is laterally displaced into a groove or recess or both to release the follower from a notch. Then, as the blade is folded to the closed position, the follower runs in the groove to eventually rest in the kickback portion of the groove when the knife is fully closed. The kickback portion of the groove lies on the same side of the cam as the ridge. When the knife is opened from the closed position, the kickback portion of the groove directs the follower into the remainder of the groove and the follower then runs along the groove to eventually slide into the notch. The tension of the locking arm forces the follower to slide into the notch. Preferably the notch is angled, as illustrated in FIG. 4. Since the shapes of the notch and the follower are complementary, that is, they mate, an angled notch provides both an easier release of the follower from the notch when the follower is laterally displaced from the notch and a tighter fit as the follower slides into the notch. That is, the lock is self-adjusting.

Figure 6:
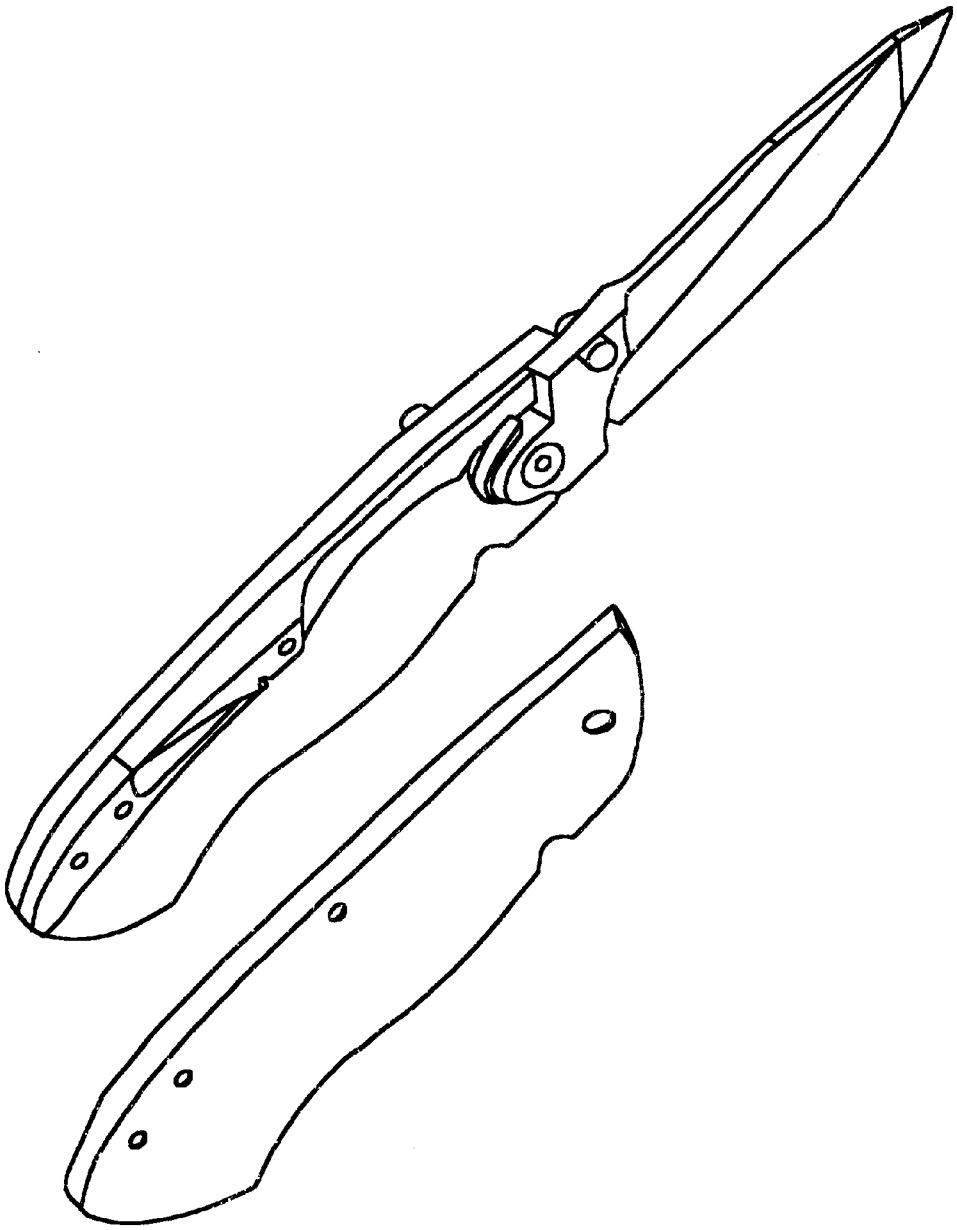
FIG. 6 is a side elevation view of another embodiment of the invention.
Figure 7:
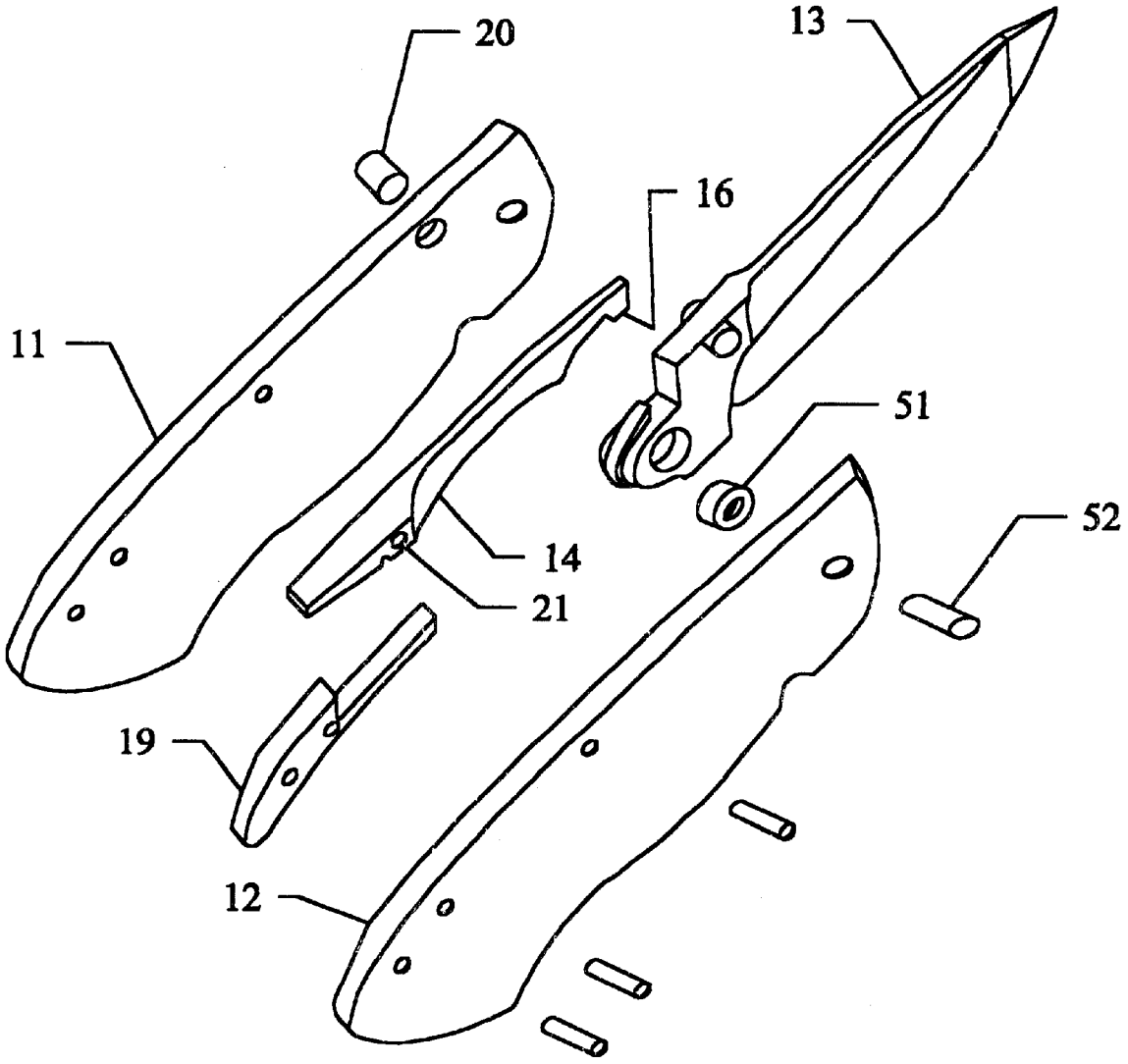
FIG. 7 is an exploded view of the embodiment of FIG. 6.
Figure 8:
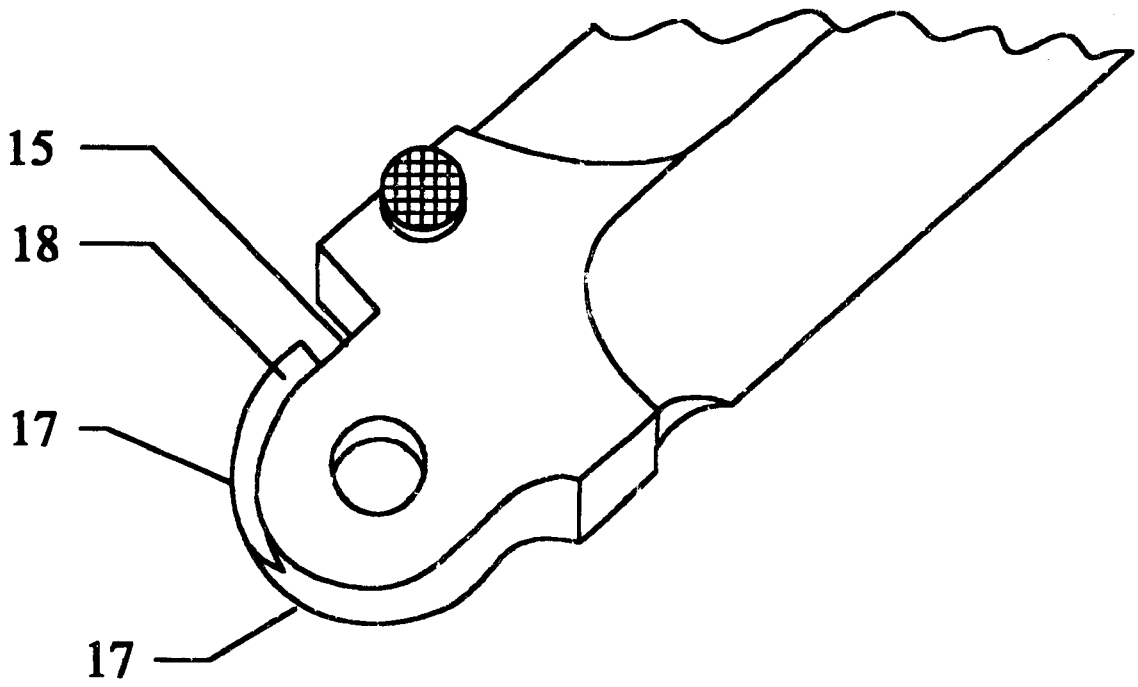
FIG. 8 is a detailed view of the tang of the blade of FIG. 6.

FIGS. 6–8 illustrate a folding knife comprising first side plate 11, second side plate 12, blade 13, locking arm 14 and spring 19. The tang of the blade comprises notch 15 and a cam. The locking arm comprises follower 16 and pivot hole 21. A pin is inserted through pivot hole 21. The cam comprises ridge 17 and groove 18. The follower and notch are complementary to permit securing the blade in the open and locked position when the follower is situated in the notch. The blade is released from the notch by the lateral displacement of the follower into the groove. In this embodiment, the depth of the groove tapers to become level with the ridge and the locking arm is free to pivot about the pin inserted through hole 21. An example of an optional releasing means, button 20, is also illustrated. Although a button is illustrated, any suitable mechanical releasing means may be utilized. Also illustrated is hub 51. The hub is optional and the diameter of the hole in the hub is variable. A hub is used whenever it is necessary to adapt the diameter of the hole in the tang to the diameter of an axle pin 52.

In operation, starting from the open and secured position, the follower is laterally displaced into the groove or a recess or both to release the lock. Then, as the blade is folded to the closed position, the follower runs in the groove to eventually rest on the ridge portion of the cam when the knife is fully closed. When the knife is opened from the closed position, the follower runs along the ridge, similar to the mechanism of a conventional lock back system, and drops into the notch. The tension of the spring holds the follower in the notch. The length of the locking arm is determined by the point at which the groove becomes level with the ridge as well as other factors such as the presence or absence of a recess in the side plate and the length of the blade.

The lateral displacement of the follower from a notch or insert is achieved by placing a finger in a suitable indent, such as for example indent 10 and applying manual pressure or by activating a releasing means such as, for example, button 20.

It should be noted that the width of a groove and the width of a recess are determined by the width of the follower which in turn is determined by the width of the notch and that the widths of the knife, cam, notch, groove, recess and follower are all interdependent. Typically, when there is no recess, the widths of the notch, follower and groove are all about the same and are about half the width of the tang end of the blade. And, when there is no groove, the widths of the notch, follower and recess are all about the same and are about half the width of the tang end of the blade. When both a groove and a recess are present, the widths of the notch and the follower are about the same and are about the same as the sum of the widths of the groove and the recess Another embodiment is a folding knife comprising a locking arm and a recess in the second side plate. For example, as the blade becomes shorter and as the thickness of the blade decreases, the width of the groove becomes narrower and even eliminated. The length of the locking arm can be as short as the length of the notch. When the locking arm is as short as the notch, a suitable spring is utilized to hold the locking arm in the notch when the blade is extended to the fully open position. To prevent a short locking arm from falling out of a recess, the recess and locking arm are complementary and interlocking similar to a joint, such as, for example, dovetail, tongue in groove or rabbet joints, which provides that the locking arm undermines at least a portion of the top edge of the recess.

Figure 9:
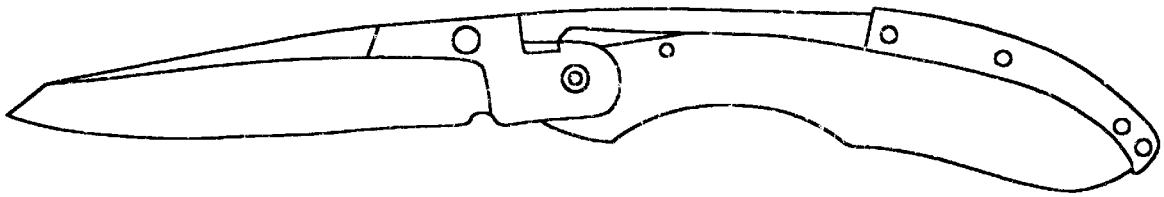
FIG. 9 is a cut away view of an embodiment of the invention.
Figure 10:
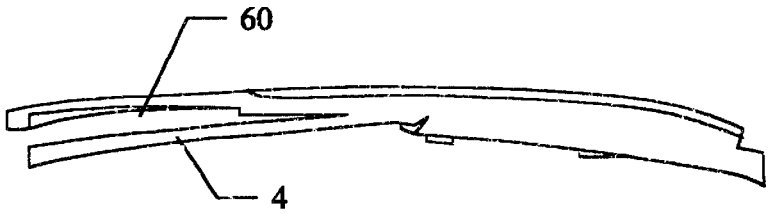
FIG. 10 is a top view of a side plate and locking arm of the embodiment of FIG. 9.
Figure 11:
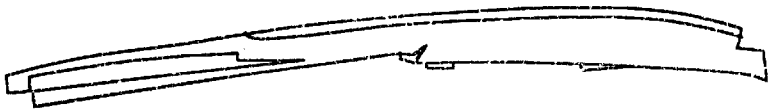
FIG. 11 is a view of FIG. 10 with the locking arm recessed.

The most preferred embodiment is illustrated in FIGS. 9, 10 and 11. FIG. 9 illustrates a knife in the fully open position, with the locking arm attached to the second side plate. FIG. 10 is an illustration of the top view of the second side plate of the knife of FIG. 9 with the locking arm out of the recess 60, as would be the case when the knife is in the fully open position with the follower situated in the notch of the blade. FIG. 11 is an illustration of the top view of the second side plate of the knife of FIG. 9 with the locking arm in the recess, as would be the case when the knife is in the fully closed position with the follower situated in the recess of the second side plate. Thus FIG. 11 is the same as FIG. 10 with the locking arm recessed. Notably, in this embodiment, the cam of the tang need not have either a groove or a kickback. However, optionally, the cam comprises either a groove or a kickback or both.

It is noted that the locking arm can be attached to either the first side plate or to the second side plate. Preferably, when a recess is present, for ease of manufacture and cost efficiency, a locking arm is attached to the same side plate that comprises the recess.

Although preferred embodiments have been described and illustrated, the invention is not intended to be limited to the exact embodiments. The scope of the invention is intended to be determined by the claims interpreted in light of the specification and the prior art.

Figure 12:
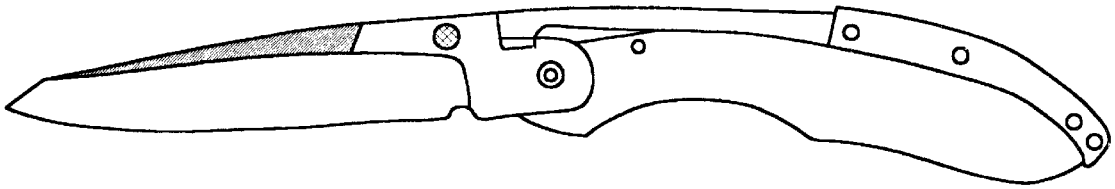
(prior art) Figure 12
FIG. 12 is a comparative illustration of the invention and the prior art of Haddan.
Figure 12:
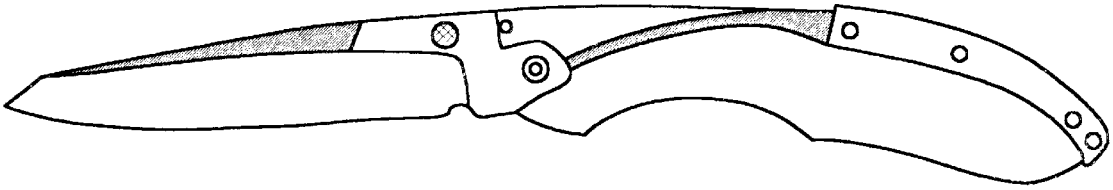
(prior art) Figure 12

FIG. 12 is an illustration demonstrating some of the differences between the knife herein disclosed (above) and the knife disclosed by Haddan (below). For example, the tension of the spring or locking arm of Haddan applies a torque to the edge of the cam causing the blade to open. The locking arm of the invention herein disclosed is torque free and does not rotate the blade to either open or close the knife.

What is claimed is:

1. A folding knife comprising:

a blade having a first edge, a second edge, a first side, a second side, and an end tang;

a first side plate disposed on the first side of said blade;

a second side plate disposed on the second side of said blade;

an axle disposed within aligned apertures in said side plates and passing through said tang so as to permit pivoting of said blade from a fully closed position, wherein said blade lies between said side plates, and a fully open position;

a locking arm fixedly disposed between said side plates, said locking arm having a spring bias end portion which includes a cam following extension at an end of the spring bias end portion;

a cam disposed on said end tang, said cam having a ridge in lateral contact with said cam following extension which is urged sideways against said ridge by said spring bias end of said locking arm, said ridge terminating a sufficient distance from one said edge of said blade so as to form a notch, said notch being defined by the one said edge and said ridge and into which said cam following extension is urged as said blade is pivoted into the open position, whereby said blade is locked into the open position and said notch acts as a stop against further blade motion.

2. The knife of claim 1 further comprising a recess in one said side plates whereby said blade is released from a locked and open position by at least partial sideways displacement of said cam following extension into said recess.

3. The knife of claim 1 further comprising a grove in said cam whereby said blade is released from a locked and open position by at least partial sideways displacement of said cam following extension into said groove.

4. The knife of claim 1 further comprising a kickback, said kickback being defined as an inclination of one side of the blade toward the other side of the blade and into which said cam following extension is urged by a sideways tension of said spring bias end of said locking arm as said blade is pivoted into the closed position, whereby said blade is secured in the closed position.

5. A folding knife comprising:

a blade having a first edge, a second edge, a first side, a second side, and an end tang;

a first side plate disposed on the first side of said blade;

a second side plate disposed on the second side of said blade;

an axle disposed within aligned apertures in said side plates and passing through said tang so as to permit pivoting of said blade from a fully closed position, wherein said blade lies between said side plates, and a fully open position;

a locking arm fixedly disposed between said side plates, said locking arm having a spring bias end portion which includes a cam following extension at an end of the spring bias end portion;

a cam disposed on said end tang, said cam having a ridge in lateral contact with said cam following extension which is urged sideways against said ridge by said spring bias end of said locking arm, said ridge terminating a sufficient distance from one said edge of said blade so as to form a notch, said notch being defined by the one said edge and said ridge and into which said cam following extension is urged as said blade is pivoted into the open position, whereby said blade is locked into the open position and said notch acts as a stop against further blade motion;

a recess in said second side plate whereby said blade is released from a locked and open position by at least partial sideways displacement of said cam following extension into said recess.

6. The knife of claim 5 further comprising a grove in said cam, said grove being on said second side of said blade, whereby said blade is released from a locked and open position by at least partial sideways displacement of said cam following extension into said groove.

7. The knife of claim 5 further comprising a kickback, said kickback being on said second side of said blade, said kickback being defined as an inclination of said second side of said blade toward said first side of said blade and into which said cam following extension is urged by a sideways tension of said spring bias end of said locking arm as said blade is pivoted into the closed position, whereby said blade is secured in the closed position.

8. A folding knife comprising:

a blade having a first edge, a second edge, a first side, a second side, and an end tang;

a first side plate disposed on the first side of said blade;

a second side plate disposed on the second side of said blade;

an axle disposed within aligned apertures in said side plates and passing through said tang so as to permit pivoting of said blade from a fully closed position, wherein said blade lies between said side plates, and a fully open position;

a locking arm fixedly disposed between said side plates, said locking arm having a spring bias end portion which includes a cam follwing extension at an end of the spring bias end portion;

a cam disposed on said end tang, said cam having a ridge side with a ridge on one side of said cam and a groove side with a groove on the other side of said cam, said spring bias end portion of said locking arm having a tension directed away from the groove side of said blade toward the ridge side of said blade, said ridge terminating a sufficient distance from one said the one edge of said blade so as to form a notch, said notch being defined by said edge and said ridge and into which said cam following extension moves as said blade is pivoted into the open position, whereby said blade is locked into the open position and said notch acts as a stop against further blade motion and whereby said blade is released from a locked and open position by at least partial sideways displacement of said cam following extension into said groove.

9. The knife of claim 8 further comprising a kickback, said kickback being defined as an inclination of the groove side of said cam toward the ridge side of said cam and into which said cam following extension is urged by a sideways tension of said spring bias end portion of said locking arm as said blade is pivoted into the closed position, whereby said blade is secured in the closed position.

* * * * *